US005735465A

United States Patent [19]

Laforcade

[11] Patent Number: 5,735,465

[45] Date of Patent: Apr. 7, 1998

[54] AEROSOL DISPENSER WITH TWO SPRAY NOZZLES

[75] Inventor: Vincent De Laforcade, Rambouillet, France

[73] Assignee: L 'Oreal, Paris, France

[21] Appl. No.: 623,784

[22] Filed: Mar. 29, 1996

[30] Foreign Application Priority Data

Mar. 31, 1995 [FR] France ..... 95 03838

[51] Int. Cl.[6] ..... B05B 11/00; B05B 1/14

[52] U.S. Cl. ..... 239/337; 239/414; 239/416.4; 239/549; 239/568

[58] Field of Search ..... 239/549, 543, 239/562–564, 416.4, 414, 337, 568; 222/385, 383

[56] References Cited

U.S. PATENT DOCUMENTS

| | | | |
|---|---|---|---|
| 3,246,850 | 4/1966 | Bourke | 239/561 X |
| 3,406,913 | 10/1968 | Frangos | 239/543 |
| 3,628,733 | 12/1971 | Kahn | 239/337 |
| 3,685,695 | 8/1972 | Yuhas . | |
| 3,870,205 | 3/1975 | Bucaro . | |
| 3,976,223 | 8/1976 | Jass et al. . | |

FOREIGN PATENT DOCUMENTS

| | | | |
|---|---|---|---|
| 0 379 627 | 8/1990 | European Pat. Off. . | |
| 2 318 684 | 5/1975 | France . | |
| 49603 | 7/1965 | Poland | 239/337 |
| 1 260 616 | 1/1972 | United Kingdom . | |
| WO 93/23174 | 11/1993 | WIPO . | |

*Primary Examiner*—Kevin Weldon

*Attorney, Agent, or Firm*—Oblon, Spivak, McClelland, Maier & Neustadt, P.C.

[57] ABSTRACT

A dispenser includes a valve for dispensing a liquid product to be dispensed in the form of an aerosol with the aid of a propellent gas. The valve is mounted on a container which contains the liquid and is equipped with a hollow operating stem including a product inlet and a product outlet, a push-button for actuating the valve via the stem, first and second nozzles provided in the push-button, and first and second ducts, respectively linking the first and second nozzles to the outlet of the stem. The first nozzle is a nozzle which is capable of delivering a spray having a mechanical effect and the second nozzle is a nozzle which is capable of delivering a spray of product. The dispenser is used especially for spraying hair lacquer.

14 Claims, 4 Drawing Sheets

AEROSOL DISPENSER WITH TWO SPRAY NOZZLES

BACKGROUND OF THE INVENTION

1. Field of the Invention

The invention relates to a dispenser for dispensing a liquid product under the action of a propellent gas. The dispenser comprises a container forming a reservoir for the product. The dispenser may in particular be used in the field of cosmetics for dispensing a hair lacquer, or an anti-louse lotion, in the pharmaceutical field for dispensing insect repellent, and in the field of agriculture for dispensing insecticides.

The dispenser of the invention comprises a container equipped with a dispensing valve and containing the product to be sprayed. The valve is equipped with a hollow operating stem including a product inlet and a product outlet; a push-button for actuating the valve via the stem; a first nozzle and a second nozzle which are provided in the push-button, and a first duct and a second duct respectively linking the first and second nozzles to the outlet of the stem.

2. Discussion of the Background

A lacquer dispenser of this sort has been described in German Utility Model MU 70 42 354. The two sprays delivered by two identical nozzles combine without excessive divergence during spraying, this making it possible to limit the production of mist and therefore to reduce the wastage of product into the atmosphere.

Naturally, hair is freely grouped together in very loose locks. Now, when such a dispenser is used to dispense hair lacquer, the two sprays deposit the product on the hair while it maintains only the initial shape of the head of hair after the hair has been styled: in other words, the hairs are joined together. Thus, this dispenser does not allow the hair to be divided into locks during spraying in order to obtain a set which looks natural.

SUMMARY OF THE INVENTION

The present invention therefore aims to overcome the drawback mentioned hereinabove.

An object of the present invention is to provide for a dispenser of the sort defined previously, which makes it possible to deliver a spray which gives the head of hair a natural set and hold.

The Applicant Company has discovered, unexpectedly and surprisingly, that such a result could be obtained by simultaneously delivering a powerful spray with mechanical effect capable of pushing the head of hair to create a hollow and of depositing the product in this hollow, and a gentle spray for depositing the product on the two edges of the hollow.

The present invention therefore provides for a novel dispenser which includes a valve for dispensing a liquid product to be dispensed in the form of an aerosol with the aid of a propellent gas. The valve is mounted on a container containing the liquid and is equipped with a hollow operating stem including a product inlet and a product outlet, a push-button for actuating the valve via the stem, first and second nozzles provided in the push-button, and first and second ducts respectively linking the first and second nozzles to the outlet of the stem. The dispenser is characterized in that the first nozzle is a nozzle capable of delivering a spray having a mechanical effect and in that the second nozzle is a nozzle capable of delivering a spray of product.

According to the invention, the first nozzle is a nozzle capable of delivering a narrow spray and the second nozzle is a nozzle capable of delivering a wider spray. According to the invention, the mechanical spray forms a total angle ranging from 5° to 20° for example, and the spray of product forms a total angle ranging from 20° to 60°, for example.

As a matter of preference, the second duct communicates with an annular chamber delimited by an element in the form of a post having a front face pressed against an internal face of the second nozzle, the front face of the post being distant from the internal face of the second nozzle by a distance $d_2$ ranging from 0 mm to 0.05 mm.

Moreover, the first duct preferably communicates with an annular chamber delimited by an element in the form of a post having a front face pressed against an internal face of the first nozzle, the front face of the post being distant from the internal face of the first nozzle by a distance $d_1$ greater than $d_2$ such that the difference $d_1-d_2$ ranges from 0.05 mm to 0.3 mm, for example.

Advantageously, the first nozzle may be equipped with an orifice with a shape which is cylindrical, about an axis substantially parallel to the axis of the spray with mechanical effect, but another shape could be envisaged (elliptical). The cylindrically shaped orifice of the first nozzle may, for example, have a diameter ranging from 0.2 mm to 1 mm.

In an embodiment of the invention, the second nozzle may be equipped with an external face and with an orifice with a shape which is flared along an axis substantially parallel to the axis of the spray of product, the larger-diameter cross-section of the orifice of the flared shape being situated on the external face of the first nozzle. Any other shape could be envisaged.

The flared orifice of the second nozzle may have a larger-diameter cross-section ranging from 0.3 mm to 1.2 mm.

According to an alternative form of the invention, the propellent gas may be sprayed through the first nozzle to form the spray with mechanical effect. In this case, the valve stem includes two axial cylinders.

According to another alternative form of the invention, the liquid may be sprayed simultaneously by both nozzles.

According to a further aspect of the invention, the stem has a longitudinal axis and the two nozzles are situated one above the other with respect to this longitudinal axis.

Moreover, the first nozzle may be offset from the second nozzle with respect to the longitudinal axis of the stem.

BRIEF DESCRIPTION OF THE DRAWINGS

In describing the preferred embodiments of the present invention illustrated in the drawings, specified terminology is employed for the sake of clarity. However, the invention is not intended to be limited to the specific terminology so selected, and it is to be understood that each specific element includes technical equivalents which operate for a similar purpose.

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
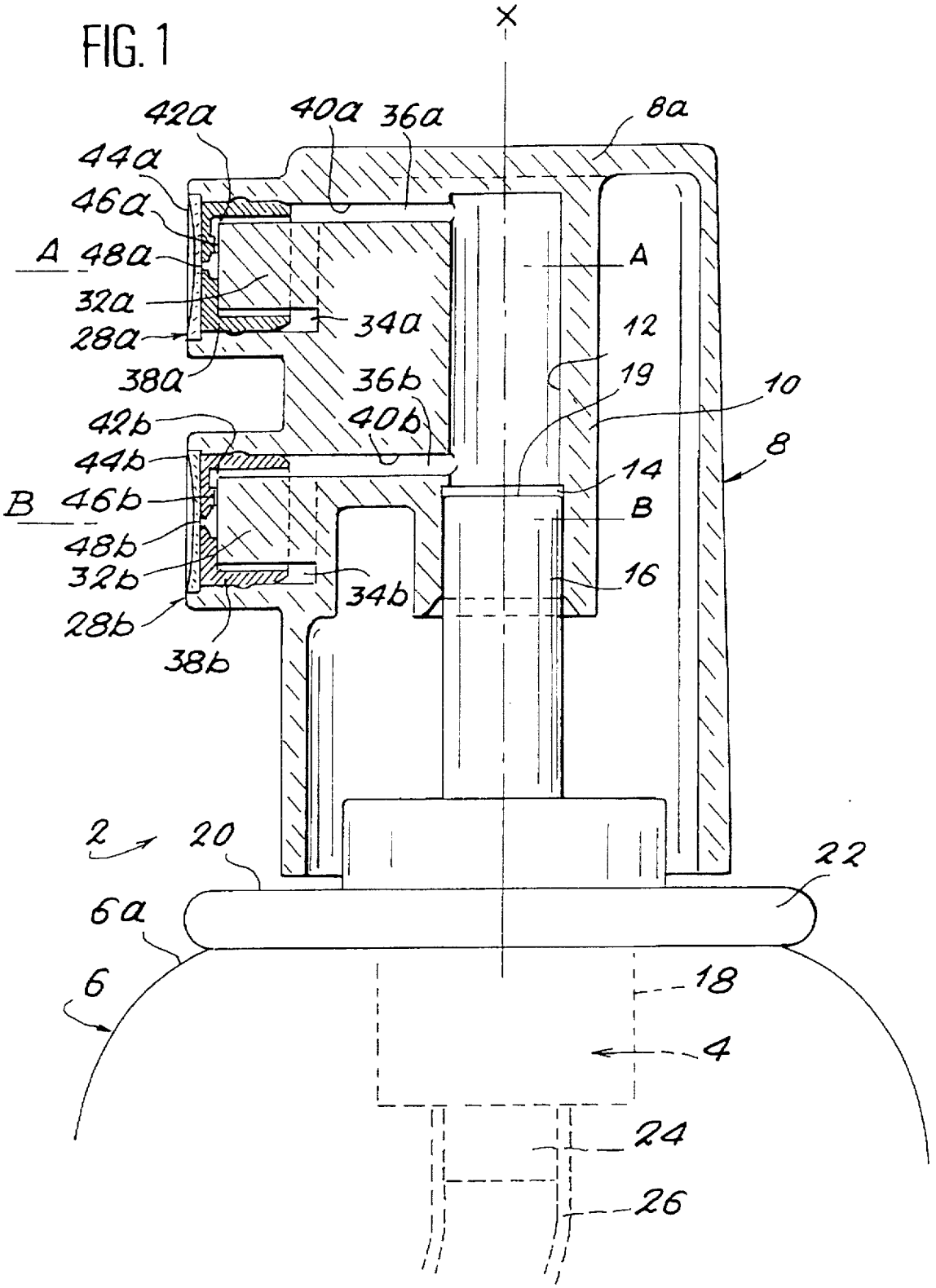
FIG. 1 is an axial section through a dispenser in accordance with a first embodiment of the invention.

Referring now to the drawings, wherein like reference numerals designate identical or corresponding parts throughout the several views, and more particularly to FIG. 1 thereof, illustrated in FIG. 1 is a dispenser denoted overall by the reference numeral 2, including a dispensing valve 4 equipping a container 6, generally cylindrical, pressurized using a propellent gas and exhibiting an axis X of symmetry. The container 6 additionally includes a liquid product, for example, a cosmetic product to be dispensed in the form of an aerosol. It is also possible to use a container equipped with a pocket containing the product or with a piston on which a propellent gas acts indirectly.

The device 2 additionally comprises a push-button 8 fixed to the container 6 or to the upper part of the valve 4. The push-button 8 includes, along the axis X, a cylindrical peg 10 integral with the upper wall 8*a* of the push-button 8. The peg 10 has an axial duct 12 passing through it.

The free end (on the container side) of the duct 12 has a bore 14 having a diameter larger than that of the duct 12 so as to form a housing capable of accommodating, gripping it slightly, the free end of an operating stem 16 of the valve 4. The valve 4 is a conventional valve made to open by depressing the stem 16 along the axis X, the axis X also constituting the longitudinal axis of the stem. The valve 4 has a body 18 which is crimped, at the top, on the operating stem side, into a dished part 20 crimped or rolled onto a circular opening made at the top of a dome 6*a* of the container 6. The dished part 20 has a rolled edge 22 and covers the upper end of the dome 6*a* of the container 6. The lower part of the valve body 18, situated on the opposite side to the operating stem 16 is equipped with a connection region 24, extended by a dip tube 26 stretching as far as the bottom of the container 6.

The free end 19 of the stem 16 constitutes the product outlet of the stem 16, the other end of the stem 16 (not represented) situated inside the valve body 18 constitutes the product inlet of the stem 16.

The push-button 8 includes, according to the invention, a first spray nozzle 28*a* and a second spray nozzle 28*b*. Each nozzle 28*a*, 28*b* is a component attached to the push-button 8 and includes, in a known fashion, swell-inducing supply passages. Those parts of the dispenser which relate to the first nozzle 28*a* will take the suffix a and those relating to the second nozzle 28*b* will take the suffix b.

The push-button 8 additionally includes two elements 32*a*, 32*b* in the form of posts, of circular cross-section, the wall of which delimits an annular chamber 34*a*, 34*b* respectively fed by a passageway 36*a*, 36*b* communicating with the duct 12. The elements 32*a*, 32*b* in the form of posts have axes of symmetry A—A, B—B which are mutually parallel and are perpendicular to the axis X.

The nozzles 28*a*, 28*b* respectively include a peripheral skirt 38*a*, 38*b* which is inserted in the annular chamber 34*a*, 34*b* against the outer wall 40*a*, 40*b* of the chamber 34*a*, 34*b*. Each nozzle 28*a*, 28*b* also has an internal face 42*a*, 42*b* and an external face 44*a*, 44*b*. Each post 32*a*, 32*b* exhibits a front face 46*a*, 46*b* parallel to the internal face 42*a*, 42*b* of the nozzle 28*a*, 28*b* which presses against it.

Figure 2:
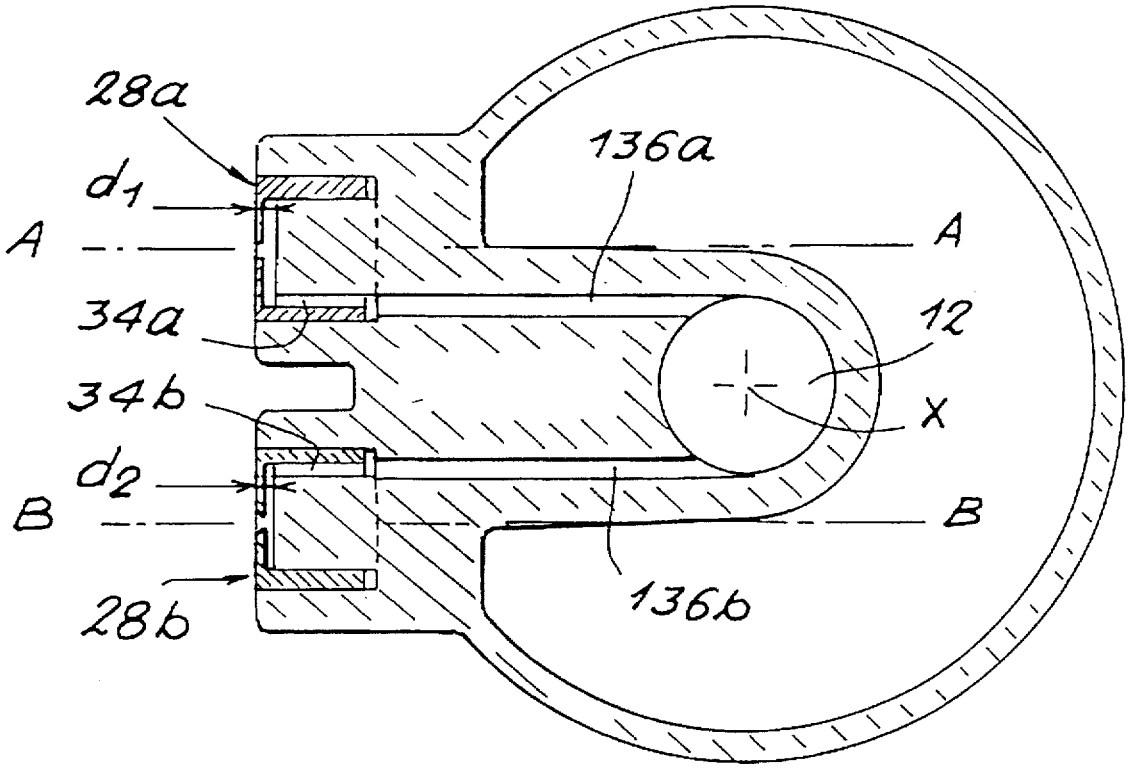
FIG. 2 is a view from above of a dispenser in accordance with a second embodiment of the invention.

The internal face 42*a* of the first nozzle 28*a* is distant from the front face 46*a* of the post 32*a* by a distance $d_1$ which may, for example, be 0.15 mm. Likewise, the internal face 42*b* of the second nozzle 28*b* is distant from the front face 46*b* of the post 32*b* by a distance $d_2$ which may, for example, be from 0 mm to 0.05 mm. In FIG. 2, the distance $d_2$ has been exaggerated for better understanding. The distance $d_1$ is greater than the distance $d_2$ as seen more clearly in FIG. 2.

In order to spray product through the nozzles 28*a*, 28*b*, these respectively include an orifice 48*a*, 48*b*. The orifice 48*a* of the first nozzle 28*a* has a shape which is cylindrical along the axis A—A. The diameter of the orifice 48*a* may, for example, be 0.4 mm. The orifice 48*b* of the second nozzle 28*b* has a shape which is flared along the axis B—B, the larger-diameter cross-section being situated on the external face 44*b* of the nozzle 28*b*. The larger-diameter cross-section may, for example, be 0.8 mm and the smaller-diameter cross-section 0.3 mm.

As shown in FIG. 1, the first nozzle 28*a* is situated above the second nozzle 28*b* along the longitudinal axis X—X of the operating stem 16 of the valve 4. In other words, the axes A—A, B—B of the nozzles 28*a*, 28*b* are situated in one and the same plane passing through the axis X—X.

When a force is applied to the push-button 8, the product contained in the container 6 is sprayed out through the duct 12, the passages 36*a*, 36*b* and the orifices 48, 48*b* of the nozzles 28*a*, 28*b* under the action of the propellent fluid. The first nozzle 28*a* delivers a narrow spray of product, having a mechanical effect, while the second nozzle delivers a wide and gentle spray of product. Thus, if such a dispenser is used to apply hair lacquer to a head of hair, the spray with mechanical effect essentially serves to create hollows in the head of hair, which hollows will be fixed using the product sprayed, and the wide and gentle spray serves to deposit the product onto the edges of the hollows thus created. Thus, when hair lacquer is applied using such a device, a natural set of the head of hair is obtained, and this set is held.

In FIG. 2, elements which are identical or fulfil roles similar to elements already described with regard to the preceding figures are denoted by the same numerical references, possibly increased by one hundred. They will not be described again, or will be described only briefly.

FIG. 2 shows a dispenser which can be distinguished from that of FIG. 1 by the fact that the two nozzles 28*a*, 28*b* are situated in one and the same plane perpendicular to the longitudinal axis X—X. Furthermore, the passages 136*a* and 136*b* are also in one and the same plane perpendicular to the axis X—X. The operation of this device is similar to that represented in FIG. 1.

Figure 3:
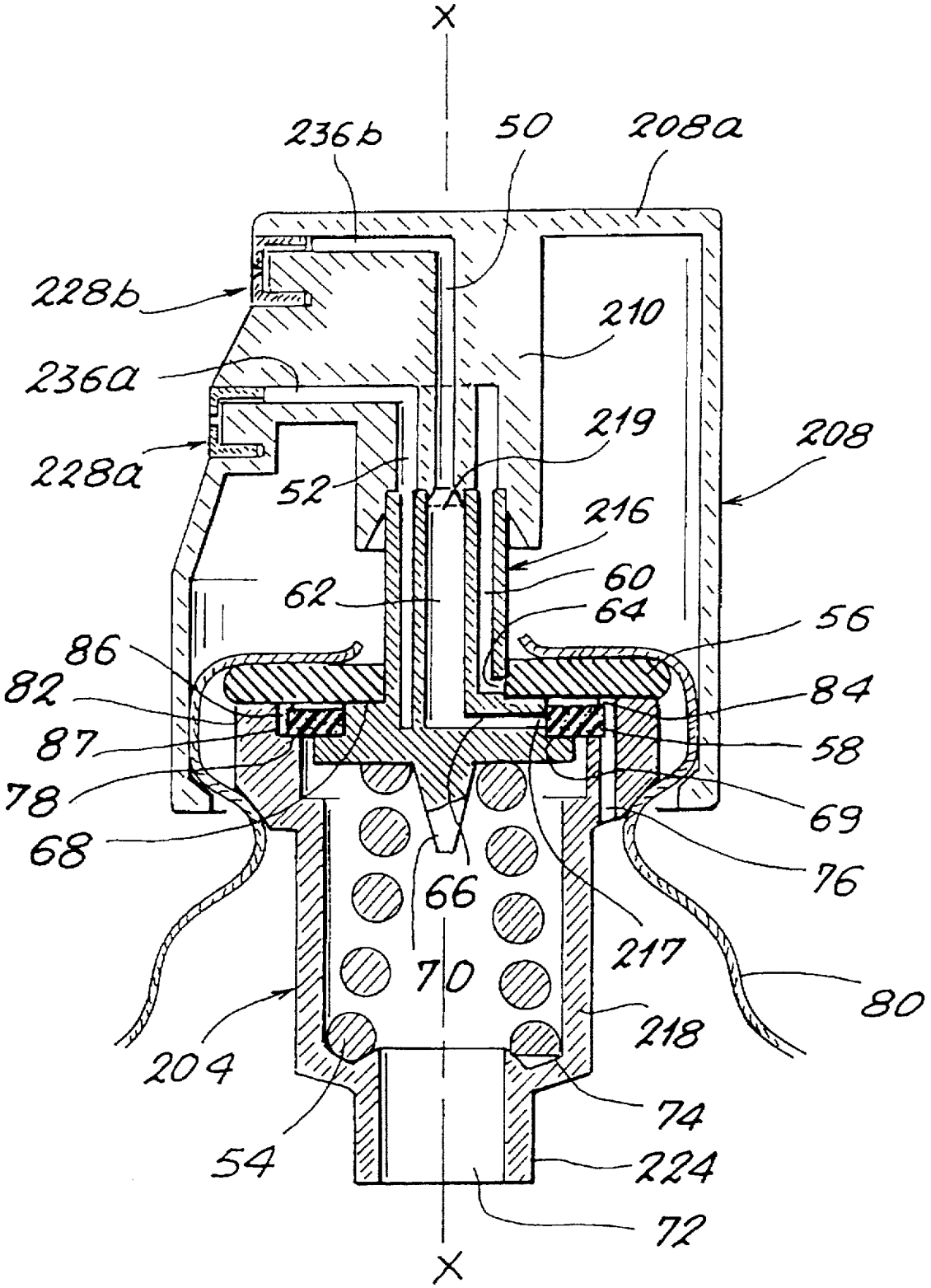
FIG. 3 is an axial section through a dispenser at rest in accordance with a third embodiment of the invention.
Figure 4:
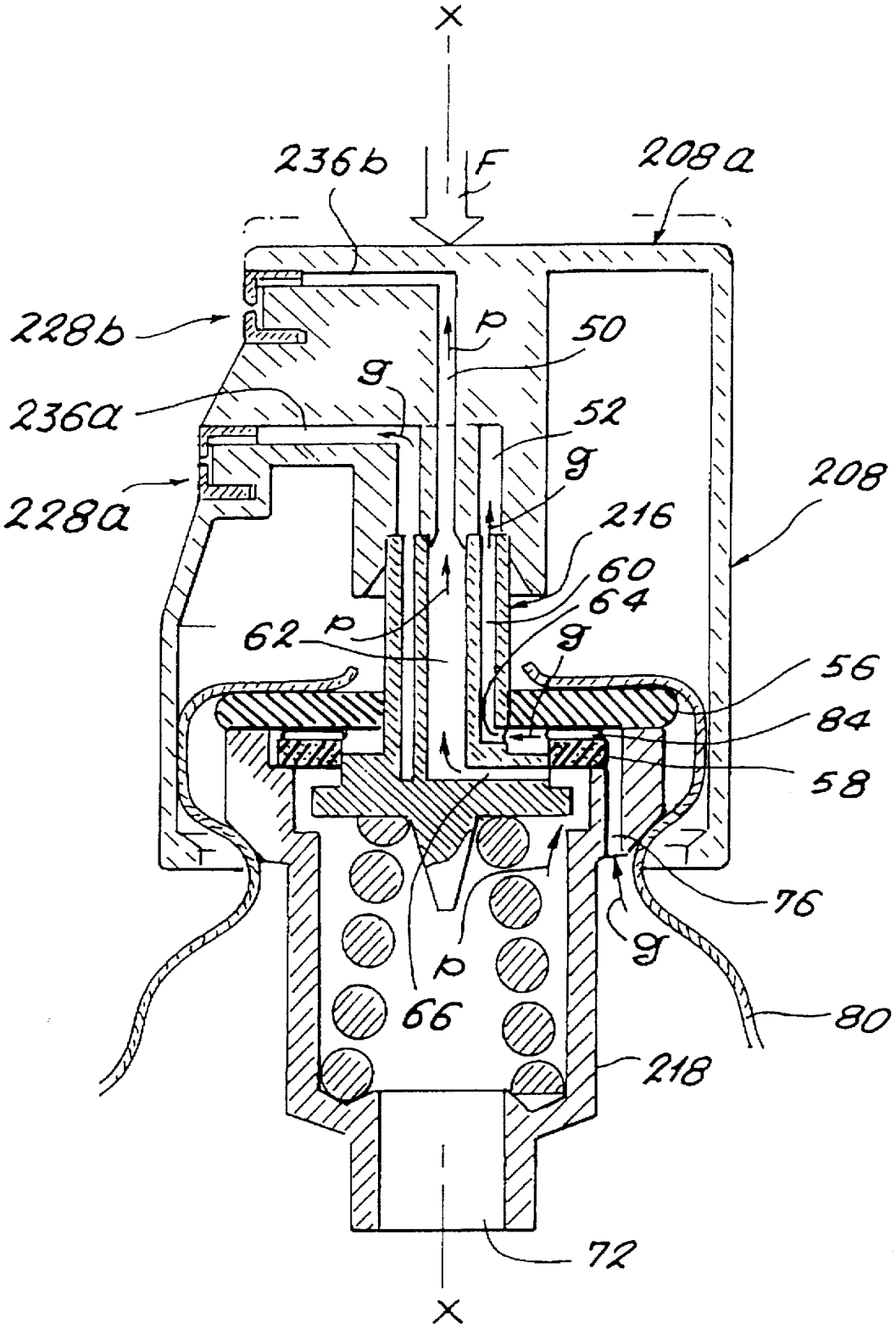
FIG. 4 represents a section similar to that of FIG. 3, the dispenser being shown in the process of spraying.

Referring to FIGS. 3 and 4, another alternative form of the dispenser according to the invention may be seen. As before, elements which differ from those of FIG. 1 bear references to which 200 has been added.

The peg 210 of the push-button 208 has a duct 50 and a coaxial annular duct 52 passing through it. The duct 52 communicates with the passage 236*a* linked to the first nozzle 228*a*. The annular duct 50 communicates with the passage 236*b* linked to the second nozzle 228*b*.

The valve 204 includes a stem 216, a valve body 218, a spring 54, a main seal 56 and a secondary seal 58.

The valve stem 216 includes two concentric cylinders: a first outer cylinder 60, and a second inner cylinder 62. Each cylinder 60, 62 emerges respectively via a radial duct 64, 66 inside the valve body 218. The free end of the duct 66 constitutes the product inlet 217 of the stem 216. The free end of the internal cylinder 62 constitutes the product outlet 219 of the stem 216.

At its base, the stem 216 also includes an upper collar 68, and a lower collar 69 provided with a cone 70, the tip of which points towards the container.

The valve body 218 in its lower part includes an opening 72 and an annular groove 74. A first end of the spring 54 is housed in the groove 74 so as to be held in place. The other end of the spring 54 is in contact with the lower part of the valve stem 216. The cone 70 allows the spring 54 to be kept centered in the valve body 218.

The valve body 218 also includes an orifice 76 and a shoulder 78 in its upper part.

The valve body 218 is crimped onto the dished part 80 of the valve. The main seal 56 is in contact with the underside of the dished part 80, with the top of the upper part 82 of the valve body 218 and with the top of the upper collar 68 of the valve stem 216, in a way which is leaktight through the action of the spring 54.

The secondary seal 58 is placed between the main seal 56 and the shoulder 78 of the valve body 218, in leaktight contact with the lower collar 69 of the stem 216 under the action of the spring 54. At its upper part it includes one or more channels 84 arranged radially with respect to the longitudinal axis of the stem 218. There is a clearance 86 between the internal wall 87 of the shoulder 78, which wall is substantially parallel to the longitudinal axis of the stem 216, and the external end of the secondary seal 58.

The free end region 224 of the valve body 218 forms a connecting region for a dip tube stretching as far as the bottom of the container. The inside of the valve body 218 is therefore filled with product to be dispensed. The orifice 76 of the valve body 218 is in contact with the vapor of the propellant.

As can be seen in FIG. 3, the free end of the duct 64 of the stem 216 emerges against the main seal 56 and the free end of the duct 66 emerges against the secondary seal 58.

To use the device of FIG. 3, as illustrated in FIG. 4, the upper part 208*a* of the push-button 208 is pressed, as indicated by the arrow F, which drives the valve stem 216 down.

As the stem 216 moves, the free end of the duct 62 comes clear of the secondary seal 58 and comes into contact with the product contained in the valve body 218. The product, under the pressure of the propellant is expelled into the duct 66 then into the internal cylinder 62 and passes into the duct 50 and into the passage 236*b* of the push-button 208 in order to be dispensed in the form of a wide gentle spray through the second nozzle 228*b*. The product circuit is symbolized by the arrows p.

The movement of the stem also brings the free end of the duct 64 clear of the main seal 56. The propellant, in the form of a gas, contained in the container penetrates the orifice 76 of the valve body 218, then the channel 84 of the secondary seal 58 which emerges at the free end of the duct 64. The propellant thus progresses from the duct 64 towards the external cylinder 60 and passes into the annular duct 52 then into the passage 236*a* in order to be dispensed through the first nozzle 228*a*. Thus, the first nozzle 228*a* delivers a spray of propellent gas having a mechanical effect. The path of this gas is symbolized by the arrow g.

In order to better direct the product onto the target, it is possible to offset the second nozzle 228*b* with respect to the first one 228*a* so that the second nozzle 228*b* is closer to the axis X—X. The push-button therefore exhibits a setback region.

The position of the two nozzles could of course be reversed.

When the dispenser illustrated in FIGS. 3 and 4 is used to dispense a hair lacquer, the spray with mechanical effect delivered by the first nozzle 228*a* creates a hollow on the head of hair, this hollow being fixed simultaneously by the spray of product delivered by the second nozzle 228*b*. Thus a natural set and hold of the head of hair is obtained.

Obviously, numerous modifications and variations of the present invention are possible in light of the above teachings. It is therefore to be understood that within the scope of the appended claims, the invention may be practiced otherwise then as specifically described herein.

What is claimed as new and desired to be secured by Letters Patent of the United States is:

1. A dispenser comprising:

a valve for dispensing a liquid product to be dispensed in a form of an aerosol with the aid of a propellent gas, the valve being mounted on a container containing the liquid;

a hollow operating stem including a product inlet and a product outlet;

a push-button for actuating the valve via the stem;

first and second nozzles provided in the push-button; and respective first and second ducts linking the first and second nozzles to the outlet of the stem;

wherein the first nozzle is a nozzle that delivers a spray having a mechanical effect, and the second nozzle is a nozzle that delivers a spray of product, the first nozzle including means for dispersing said spray onto a narrower area than said second nozzle.

2. A dispenser according to claim 1, wherein the first nozzle means for dispensing includes an orifice with a shape which is cylindrical about an axis parallel to an axis of the spray with mechanical effect.

3. A dispenser according to claim 2, wherein the orifice of cylindrical shape of the first nozzle has a diameter ranging from 0.2 mm to 1 mm.

4. A dispenser according to claim 1, wherein the spray having a mechanical effect forms a total angle ranging from 5° to 20°.

5. A dispenser according to claim 1, wherein the spray of product forms a total angle ranging from 20° to 60°.

6. A dispenser according to claim 1, wherein the liquid contained in the container can be sprayed by both the first and second nozzles.

7. A dispenser according to claim 1, wherein the, stem has a longitudinal axis, and the first and second nozzles are situated one above the other with respect to the longitudinal axis.

8. A dispenser according to claim 1, wherein one of the first and second nozzles are offset from the other nozzle with respect to a longitudinal axis of the valve stem.

9. A dispenser comprising:

a valve for dispensing a liquid product to be dispensed in a form of an aerosol with the aid of a propellent gas, the valve being mounted on a container containing the liquid;

a hollow operating stem including a product inlet and a product outlet;

a push-button for actuating the valve via the stem;

first and second nozzles provided in the push-button; and respective first and second ducts linking the first and second nozzles to the outlet of the stem;

wherein the first nozzle is a nozzle capable of delivering a spray having a mechanical effect, and the second nozzle is a nozzle capable of delivering a spray of product, and the second duct communicates with an annular chamber delimited by an element in the form of a post having a front face pressed against an internal face of the second nozzle, the front face of the post being distant from the internal face of the second nozzle by a distance $d_2$ ranging from 0 mm to 0.05 mm.

10. A dispenser according to claim 3, wherein the first duct communicates with a further annular chamber delimited by a further element in the form of a further post having a further front face pressed against a further internal face of the first nozzle, the further front face of the further post being distant from the further internal face of the first nozzle by a distance $d_1$ greater than $d_2$ such that the difference $d_1-d_2$ ranges from 0.05 mm to 0.3 mm.

11. A dispenser comprising:

a valve for dispensing a liquid product to be dispensed in a form of an aerosol with the aid of a propellent gas, the valve being mounted on a container containing the liquid;

a hollow operating stem including a product inlet and a product outlet;

a push-button for actuating the valve via the stem;

first and second nozzles provided in the push-button; and respective first and second ducts linking the first and second nozzles to the outlet of the stem;

wherein the first nozzle is a nozzle capable of delivering a spray having a mechanical effect, and the second nozzle is a nozzle capable of delivering a spray of product, and the second nozzle is equipped with an external face and with an orifice with a shape which is flared along an axis substantially parallel to an axis of the spray of product, a larger-diameter cross-section of the orifice of the flared shape being situated on the external face of the second nozzle.

12. A dispenser according to claim 1, wherein the flared orifice of the second nozzle has a larger-diameter cross-section ranging from 0.3 mm to 1.2 mm.

13. A dispenser comprising:

a valve for dispensing a liquid product to be dispensed in a form of an aerosol with the aid of a propellent gas, the valve being mounted on a container containing the liquid;

a hollow operating stem including a product inlet and a product outlet;

a push-button for actuating the valve via the stem:

first and second nozzles provided in the push-button; and respective first and second ducts linking the first and second nozzles to the outlet of the stem;

wherein the first nozzle is a nozzle capable of delivering a spray having a mechanical effect, and the second nozzle is a nozzle capable of delivering a spray of product, and the container contains a propellent gas in sole communication with the first nozzle to form the spray with mechanical effect and the second nozzle solely sprays the product.

14. A dispenser comprising:

a valve for dispensing a liquid product to be dispensed in a form of an aerosol with the aid of a propellent gas, the valve being mounted on a container containing the liquid;

a hollow operating stem including a product inlet and a product outlet;

a push-button for actuating the valve via the stem;

first and second nozzles provided in the push-button; and respective first and second ducts linking the first and second nozzles to the outlet of the stem;

wherein the first nozzle is a nozzle capable of delivering a spray having a mechanical effect, and the second nozzle is a nozzle capable of delivering a spray of product, and the valve stem includes two coaxial cylinders.

* * * * *